US011268310B1

(12) United States Patent
Spangler et al.

(10) Patent No.: US 11,268,310 B1
(45) Date of Patent: Mar. 8, 2022

(54) HINGE ASSEMBLY WITH REINFORCED ABUTMENTS

(71) Applicant: Ciari Guitars, Inc., San Diego, CA (US)

(72) Inventors: Jonathan Spangler, San Diego, CA (US); James Lee, Carlsbad, CA (US)

(73) Assignee: Ciari Guitars, Inc., San Diego, CA (US)

( * ) Notice: Subject to any disclaimer, the term of this patent is extended or adjusted under 35 U.S.C. 154(b) by 0 days.

(21) Appl. No.: 16/932,697

(22) Filed: Jul. 17, 2020

Related U.S. Application Data

(60) Provisional application No. 62/993,056, filed on Mar. 22, 2020, provisional application No. 62/875,486, filed on Jul. 17, 2019.

(51) Int. Cl.

| | |
|---|---|
| ***E05D 5/06*** | (2006.01) |
| ***E05D 3/06*** | (2006.01) |
| ***E05D 3/12*** | (2006.01) |
| ***E05D 7/00*** | (2006.01) |

(52) U.S. Cl.
CPC ..... *E05D 3/12* (2013.01); *E05D 3/06* (2013.01); *E05D 5/06* (2013.01); *E05D 7/0018* (2013.01); *E05Y 2600/10* (2013.01); *E05Y 2600/622* (2013.01)

(58) Field of Classification Search
CPC .... E05D 3/06; E05D 3/12; E05D 5/04; E05D 5/06; E05Y 2600/626
See application file for complete search history.

(56) References Cited

U.S. PATENT DOCUMENTS

| | | | | |
|---|---|---|---|---|
| 519,409 A | | 5/1894 | Middlebrooke | |
| 727,697 A | * | 5/1903 | Sargent | E05D 3/00 16/283 |
| 796,113 A | * | 8/1905 | Corbett | E05D 3/12 16/366 |
| 966,380 A | * | 8/1910 | Bommer | E05D 11/04 16/276 |
| 1,418,076 A | * | 5/1922 | Hedstrom | E05D 3/12 16/302 |
| 1,554,161 A | * | 9/1925 | Hubbard | E05D 3/06 16/368 |

(Continued)

FOREIGN PATENT DOCUMENTS

| | | |
|---|---|---|
| FR | 2870380 | 11/2005 |
| GB | 2363508 | 12/2001 |
| GB | 2428862 | 2/2007 |
| WO | 2019079782 | 4/2019 |

OTHER PUBLICATIONS

Eyal Fendell, "Foldable Electric Guitar" at p. 4 of 12 of "2010 Portfolio" at www.coroflot.com/eyalfendell/portfolio2010, Publication Date 2008, 12 pages, Israel.

(Continued)

*Primary Examiner* — Jeffrey O'Brien
(74) *Attorney, Agent, or Firm* — Jonathan Spangler, Esq.; Jay Bell, Esq.

(57) ABSTRACT

A hinge assembly with reinforced abutment surfaces via the use of multiple strike plates. The strike plates are made from stronger and more robust materials than the underlying hinge, such that the strike plates bear the loads (vs. the underlying hinge material) to prevent deformation of the hinge components during use over time.

20 Claims, 15 Drawing Sheets

(56) References Cited

U.S. PATENT DOCUMENTS 2,200,692 A * 5/1940 Fairley ..... E05D 3/12 16/353
2,277,176 A * 3/1942 Wagner ..... E05D 3/12 16/366
2,372,431 A * 3/1945 Kahle ..... E05D 11/06 16/371
2,440,817 A * 5/1948 Benson ..... E05D 3/12 16/302
3,832,756 A * 9/1974 Lew ..... E05D 3/12 16/297
3,910,152 A 10/1975 Kusakawa
4,034,514 A * 7/1977 Cecil ..... E05D 5/04 49/504
4,073,211 A * 2/1978 Jorgensen ..... G10D 1/08 84/267
4,111,093 A 9/1978 Field et al.
4,118,827 A * 10/1978 Yamamoto ..... E05D 5/04 16/252
4,191,085 A 3/1980 Litwin
4,254,683 A 3/1981 Nulman
4,332,184 A 6/1982 Phillips
4,385,543 A 5/1983 Shaw et al.
4,547,930 A * 10/1985 King ..... E05D 5/023 16/247
4,553,286 A * 11/1985 Schwarz, II ..... E05D 5/04 16/222
4,592,265 A 6/1986 Steinberger
4,638,708 A 1/1987 Kamal
4,686,882 A 8/1987 Shaw
4,873,908 A * 10/1989 Moore ..... G10D 1/085 211/84
4,939,970 A 7/1990 Hoshino et al.
5,137,389 A * 8/1992 Magoon ..... F16B 7/0433 403/24
5,233,896 A 8/1993 Worthington et al.
5,353,672 A * 10/1994 Stewart ..... G10D 3/06 84/267
5,383,385 A 1/1995 Gilbert
5,390,578 A * 2/1995 Raymer ..... G10D 1/085 84/267
5,659,929 A * 8/1997 Cheng ..... E05D 3/12 16/366
5,728,956 A 3/1998 Feiten et al.
5,876,092 A * 3/1999 An ..... B60N 3/004 297/146
5,943,739 A * 8/1999 Vandergrift ..... E05D 3/12 16/366
5,949,005 A 9/1999 Peterson
6,025,548 A 2/2000 Ehrlich
6,028,255 A 2/2000 Myronyk
6,152,554 A * 11/2000 Parisi ..... E05D 7/04 16/249
6,154,926 A * 12/2000 Formiller ..... E05D 5/04 16/382
6,243,920 B1 * 6/2001 Sauve ..... E05D 3/12 16/357
6,256,839 B1 * 7/2001 Wu ..... E05D 3/12 16/283
6,353,164 B1 3/2002 Corsi
6,791,022 B2 9/2004 Green
6,833,501 B2 12/2004 Jagmin
6,956,157 B2 10/2005 Strobel
D516,114 S * 2/2006 Leach ..... G10D 1/08 D17/20
6,994,393 B2 * 2/2006 Votruba ..... B62D 63/064 16/366
7,179,975 B2 2/2007 Feiten et al.
7,332,662 B2 2/2008 Kandrack et al.
7,365,254 B2 4/2008 Johansson
7,416,364 B2 * 8/2008 Yodock, III ..... E01F 15/083 256/13.1
7,533,448 B2 * 5/2009 Chern ..... G06F 1/1616 16/342
7,617,567 B2 * 11/2009 Franchini ..... E05D 7/04 16/236
7,652,205 B2 * 1/2010 Leach ..... G10D 1/08 84/293
7,659,467 B2 2/2010 Adams
7,696,419 B2 * 4/2010 Chadwick, V ..... G10D 1/08 84/293
7,705,224 B1 4/2010 Ward
7,712,608 B2 5/2010 Leach
7,732,689 B1 6/2010 Jiang et al.
7,748,081 B2 * 7/2010 Ganter ..... E05D 7/04 16/235
7,754,950 B2 * 7/2010 Leach ..... G10D 1/08 84/293
7,872,185 B1 * 1/2011 Chadwick ..... G10D 1/08 84/293
8,119,892 B2 2/2012 Leach et al.
8,183,446 B1 5/2012 Ward
8,203,058 B2 6/2012 Leach
8,273,974 B1 9/2012 Gonzalez
8,288,637 B2 10/2012 Kingsley
8,378,192 B1 2/2013 Harmon
8,710,346 B2 4/2014 Behringer et al.
8,720,011 B1 * 5/2014 Hsu ..... G06F 1/1681 16/368
9,213,366 B2 * 12/2015 Lai ..... G06F 1/162
9,424,818 B1 * 8/2016 Spangler ..... G10D 1/08
9,466,268 B2 10/2016 Knight
9,514,719 B1 12/2016 Ward
9,556,665 B2 * 1/2017 Ritzert ..... E06B 1/524
9,617,782 B2 * 4/2017 Gramstad ..... E05D 5/128
9,633,631 B1 4/2017 Lin et al.
9,697,808 B1 7/2017 Sanzo et al.
9,816,303 B2 * 11/2017 Lee ..... E05D 5/0276
9,865,234 B2 * 1/2018 Denton ..... G10D 3/06
10,079,006 B2 9/2018 Brain
10,186,238 B2 * 1/2019 Spangler ..... G10D 1/08
10,246,917 B2 * 4/2019 Ginter ..... E05D 3/08
10,540,946 B2 1/2020 Reddick
10,810,974 B2 * 10/2020 Spangler ..... G10D 3/06
2004/0020011 A1 * 2/2004 Fang ..... E05D 3/08 16/302
2004/0182220 A1 9/2004 Strobel
2004/0194606 A1 10/2004 Koeppe et al.
2004/0212968 A1 * 10/2004 Lin ..... E05D 3/12 361/755
2005/0257344 A1 * 11/2005 Allen ..... D06F 81/02 16/371
2006/0090297 A1 * 5/2006 Chue ..... E05F 1/063 16/312
2006/0144208 A1 7/2006 Kandrack et al.
2007/0056429 A1 3/2007 Poschelk
2007/0131082 A1 6/2007 Feiten et al.
2007/0144328 A1 6/2007 Johansson
2007/0289427 A1 12/2007 Liang
2008/0141488 A1 6/2008 Leach
2008/0156180 A1 7/2008 Bagale
2009/0084243 A1 4/2009 Pyper-Scott
2009/0100981 A1 4/2009 Chadwick, V
2011/0308373 A1 12/2011 Leach et al.
2013/0058507 A1 3/2013 Ark s-Pedersen
2014/0260889 A1 9/2014 Anderson
2016/0225351 A1 8/2016 Knight
2018/0053491 A1 2/2018 Spangler et al.
2018/0211639 A1 * 7/2018 Niiro ..... G10D 3/12
2019/0295514 A1 9/2019 Spangler
2020/0011105 A1 * 1/2020 Gasser ..... E05D 11/0054
2020/0118528 A1 * 4/2020 Upton ..... G10G 5/005
2021/0056939 A1 * 2/2021 Spangler ..... G10D 3/06

OTHER PUBLICATIONS

Jason Heredia, "Arcus Collapsible Guitar" https://theawesomer.com/arcus-collapsible-guitar/11426/. Publication Date Jul. 30, 2008, 5 Pages.

(56) References Cited

OTHER PUBLICATIONS

PCT International Search Report and Written Opinion of the International Searching Authority, PCT/US2018/056802, dated Jan. 4, 2019.

* cited by examiner

HINGE ASSEMBLY WITH REINFORCED ABUTMENTS

CROSS REFERENCES TO RELATED APPLICATIONS

The present application is a non-provisional patent application claiming benefit under 35 U.S.C. § 119(e) from U.S. Provisional Application Ser. No. 62/875,486, filed on Jul. 17, 2019, and U.S. Provisional Application Ser. No. 62/993,056 filed Mar. 22, 2020, the entire contents of which are hereby expressly incorporated by reference into this disclosure as if set forth fully herein.

BACKGROUND OF THE INVENTION

I. Field of the Invention

The present invention relates generally to a hinge assembly for rotatably, connecting two structures together and, more particularly, to a hinge assembly having reinforced abutments for withstanding repeated use over time without unwanted deformation of the underlying hinge components.

II. Discussion of the Prior Art

Hinges have been used for millennia for connecting two structures together. While effective in providing rotational or movement between the two structures, some hinges have abutment surfaces that can deform over repeated use or misuse over time. The present invention is directed at overcoming, or at least improving upon, the disadvantages of the prior art.

SUMMARY OF THE INVENTION

The present invention accomplishes this goal by providing a hinge assembly with reinforced abutment to prevent deformation of the underlying hinge components during use over time. The hinge assembly has at least two components, but in one embodiment takes the form of a 3-part hinge assembly with a base hinge section (hinge base), a middle hinge section (middle hinge), and an upper hinge section (upper hinge). According to the present invention, the hinge assembly includes one or more strike plates that bolster the structural integrity of contact regions along upper portions of the hinge base, middle hinge, and upper hinge during the straightened hinge state. Each strike plate includes an abutment surface, one or more load transfer surfaces, a lower surface, an upper surface, and one or more retaining side surfaces (non-load transferring). The strike plates are secured within corresponding recesses formed along upper regions of the hinge base, middle hinge, and upper hinge.

In one aspect, there are two types of strike plates: a generally H-shaped strike plate dimensioned to be received and secured in a corresponding recess formed in the middle hinge, and two generally U-shaped strike plates dimensioned to be received and secured in corresponding recesses formed in the hinge base and upper hinge, albeit in opposite (mirrored) orientation to one another. In one aspect, each strike plate may be secured within the corresponding recess in any number of suitable fashions, including but not limited to adhesive (e.g. epoxy, super glue, etc. . . . ) and/or one or more machine screws dimensioned to extend through apertures formed in the strike plates into threaded holes formed within the corresponding hinge section.

The generally H-shaped recess of the middle hinge includes a lower surface, one or more load transfer surfaces, and one or more retaining side surfaces, which individually cooperate with the corresponding surfaces of the generally H-shaped strike plate (i.e. all except the abutment surface and upper surface). The generally U-shaped recess of the hinge base and upper hinge include a lower surface, one or more load transfer surfaces, and one or more retaining side surfaces, which individually cooperate with the corresponding surfaces of the generally U-shaped strike plate (i.e. all except the abutment surface and the upper surface).

When the hinge assembly is straightened, each adjacent abutment surface will be contacting one another (preferably in a parallel manner with maximum contact area between each abutment surface) to define a first contact region between the hinge base and the middle hinge, and a second contact region between the middle hinge and upper hinge. The first and second contact regions are disposed generally along the upper surface of the hinge assembly such that only the strike plates will be contacting on another along the upper region of the hinge assembly.

The hinge assembly may be constructed from any number of suitable materials, including but not limited to metal (e.g. aluminum), carbon-fiber, plastic, etc. . . . manufactured via any suitable techniques, including but not limited to machining, molding, 3D printing, etc. . . . . The strike plates are preferably made of a highly robust and durable material relative to the material of the hinge base, middle hinge, and upper hinge, such that the strike plates will not deform or otherwise get negatively impacted from repeated contact during the folding and unfolding over the lifetime of the hinge assembly. By way of example only, the strike plates may be constructed from tool-grade steel heat treated to achieve hardness RC, although it will be appreciated that any number of suitable materials and/or hardness and/or durometers may be employed without departing from the present invention.

BRIEF DESCRIPTION OF THE DRAWINGS

Many advantages of the present invention will be apparent to those skilled in the art with a reading of this specification in conjunction with the attached drawings, wherein like reference numerals are applied to like elements and wherein.

DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure. The hinge assembly disclosed herein boasts a variety of inventive features and components that warrant patent protection, both individually and in combination.

Figure 1:
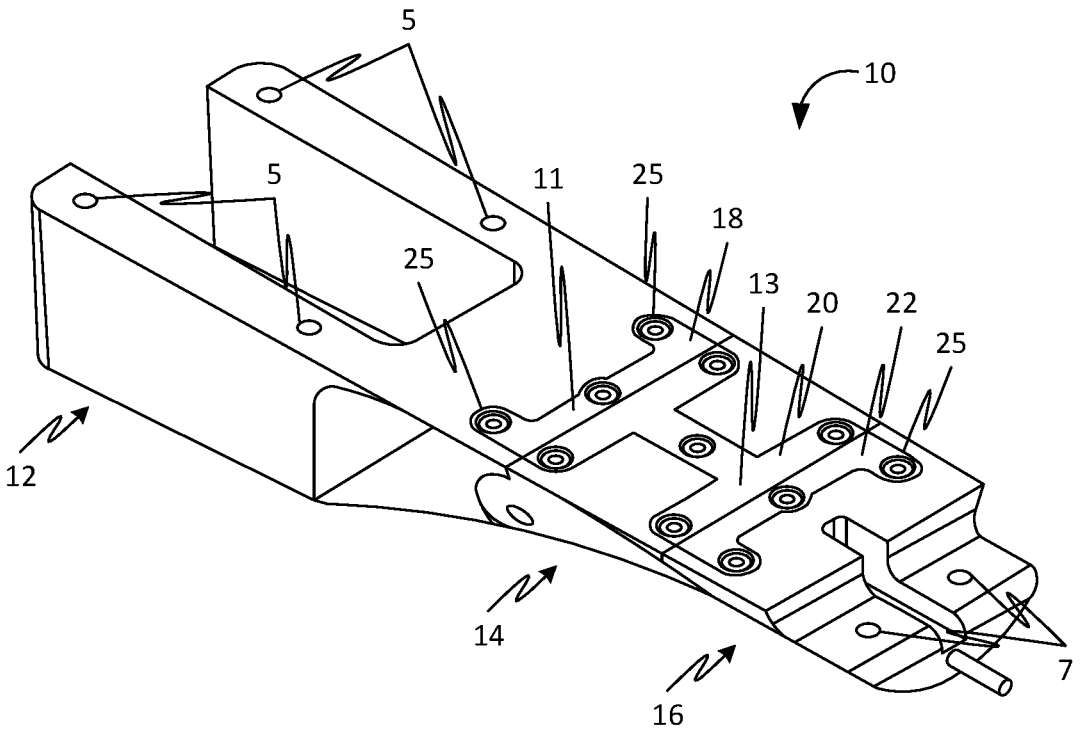
FIGS. 1-2 are perspective views (assembled and exploded) of a hinge assembly according to aspects of the present invention equipped with multiple strike plates.
Figure 2:
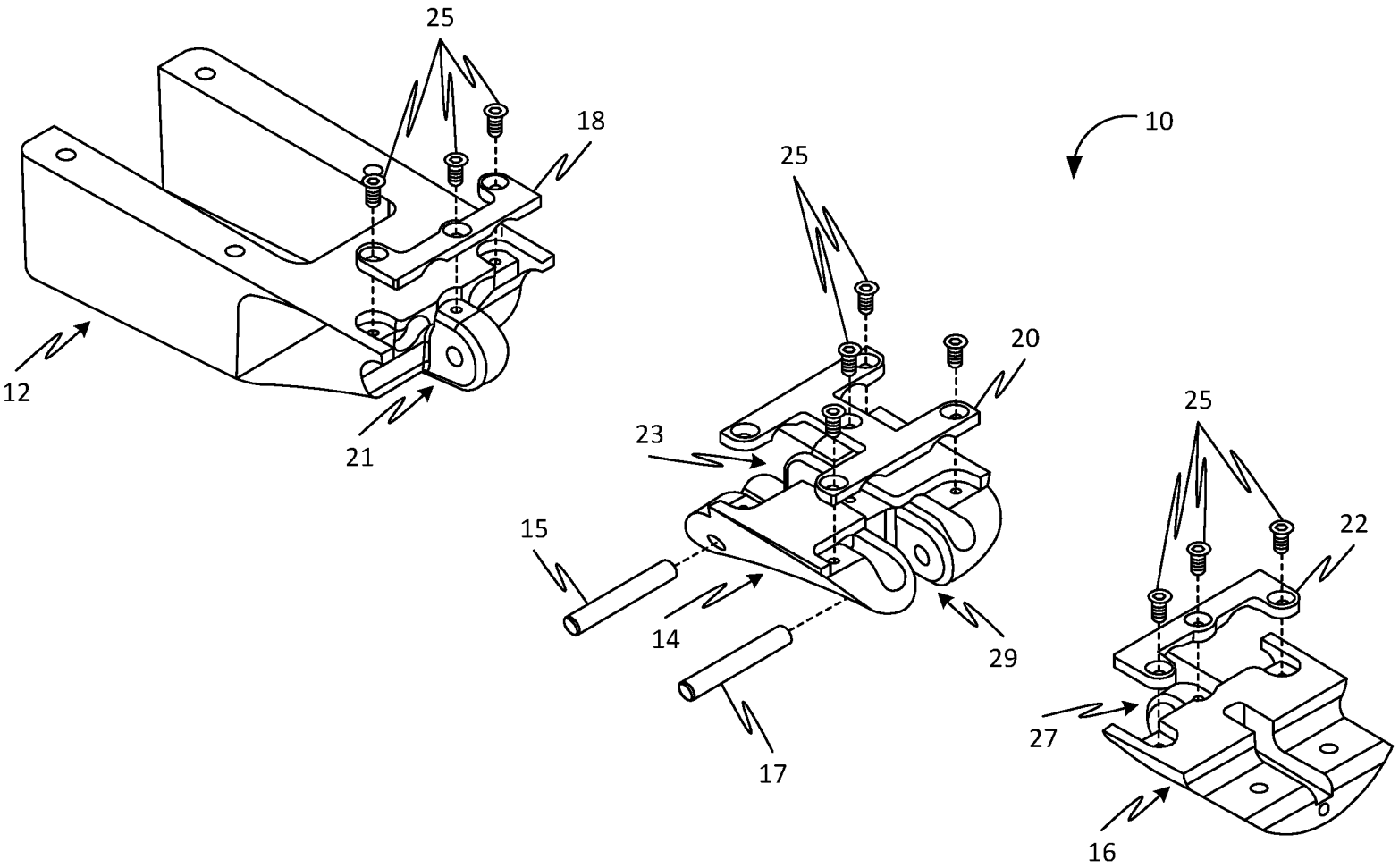

FIGS. 1-2 illustrate a 3-part hinge assembly 10 with reinforced abutments of an exemplary embodiment of the present invention. The 3-part hinge assembly 10 includes a base section 12, a middle section 14, and an upper section 16. According to the present invention, the hinge assembly 10 includes reinforced abutments in the form of, by way of example only, strike plates 18, 20, 22 coupled to the respective base section 12, middle section 14 and upper section 16 via a plurality of threaded machine screws 25. The base section 12 is hingedly coupled to the middle section 14 with a first hinge pin 15 to create a first abutment joint 11 bounded by the strike plates 18, 20. The upper section 16 is hingedly coupled to the middle section 14 with a second hinge pin 17 to create a second abutment joint 13 bounded by the strike plates 20, 22. In so doing, the strike plates 18, 20, 22 serve to bolster the structural integrity of contact regions adjacent the upper, flat surfaces of the hinge base 12, middle hinge 14, and upper hinge 16 during the straightened state shown in FIG. 1. The strike plates 18, 20, 22 thus prevent deformation of the material used to manufacture the hinge base 12, hinge middle 14, and hinge 16 that may otherwise occur during use over time.

The hinge 10 is assembled via the following steps, though not necessarily in this order: 1) interdigitating a knuckle 21 on the base section 12 into a corresponding groove 23 formed on a first side of the middle section 14; 2) interdigitating a knuckle 27 on the upper section 16 into a corresponding groove 29 on a second side of the middle section 14; 3) introducing the first hinge pin 15 through a first set of side bores formed in the middle section 14 and through an aperture in the first knuckle 21; 4) introducing the second hinge pin 17 through a second set of side holes formed in the middle section 14 and through an aperture in the second knuckle 27; 5) securing the first strike plate 18 within a recess 24 formed in the base section 12 via screws 25; 6) securing the second strike plate 20 with a recess 28 formed in the middle section 14; and 7) securing the third strike plate 22 in a recess 30 formed in the upper section 16. Once assembled, the hinge 10 may be coupled to at least two structures to provide an articulating, moveable relationship therebetween. For example, a first structure (not shown) may be connected to the base section 12 (e.g. via threaded engagement of threaded screws into threaded apertures 5 formed in the base section 12) while a second structure (not shown) may be connected to the upper section 16 (e.g. via threaded engagement of threaded screws into threaded apertures 7 formed in the upper section 16). The position of the first structure to the second structure may be altered by selectively articulating the base section 12 relative to the middle section 14 and the middle section 14 relative to the upper section 16.

Figure 3:
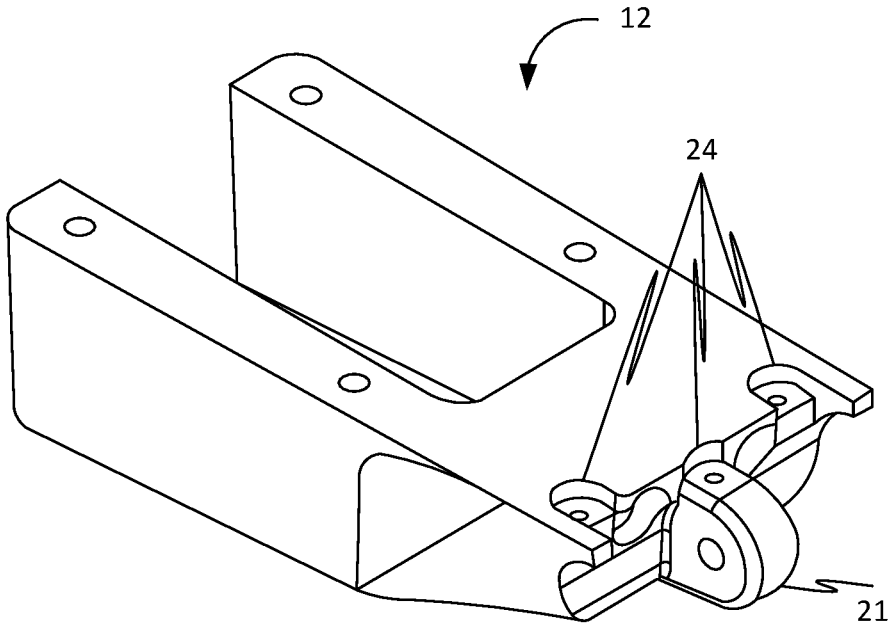
FIGS. 3-5 are various views of a hinge base forming part of the hinge assembly of FIGS. 1-2 according to aspects of the invention.
Figure 4:
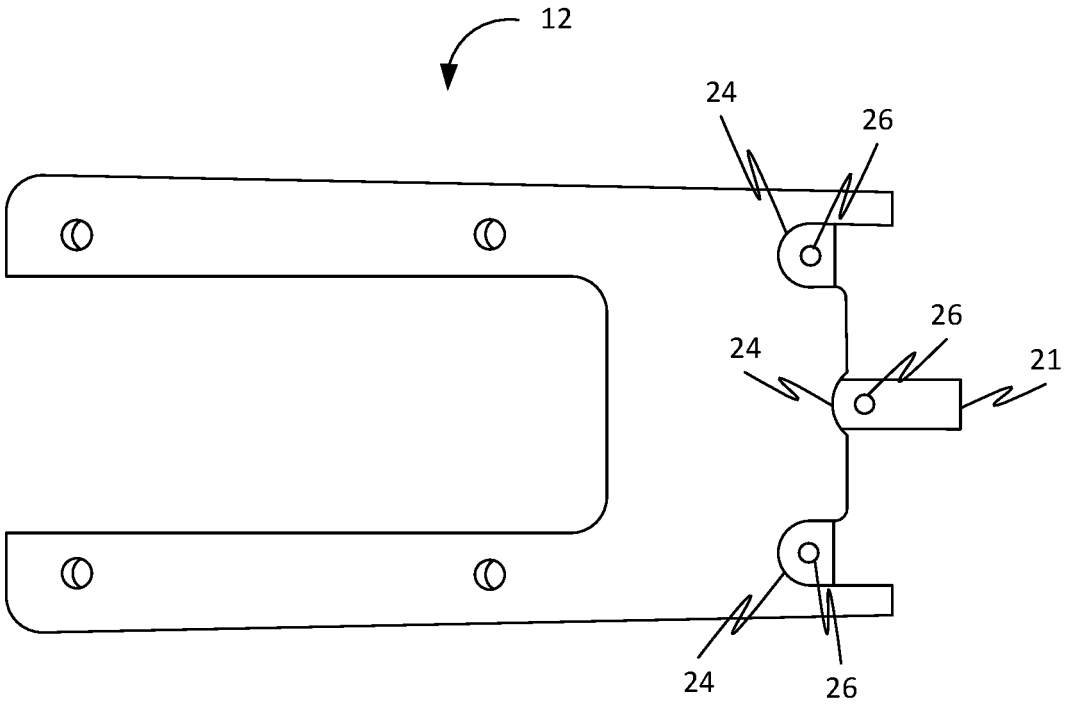
Figure 5:
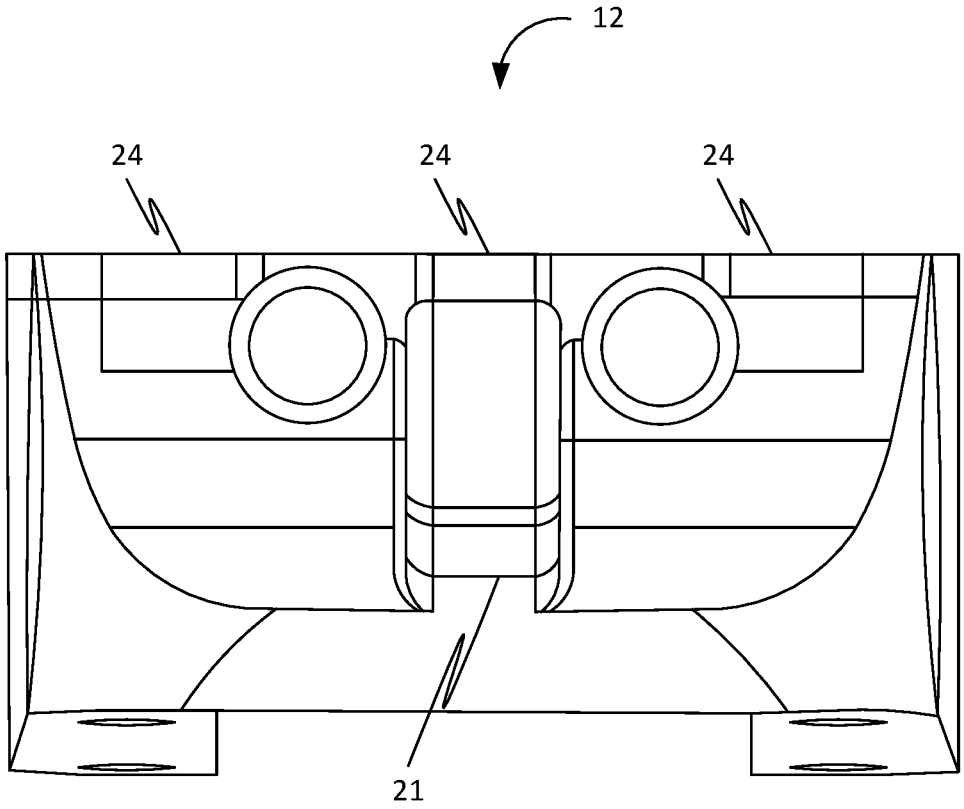
Figure 6:
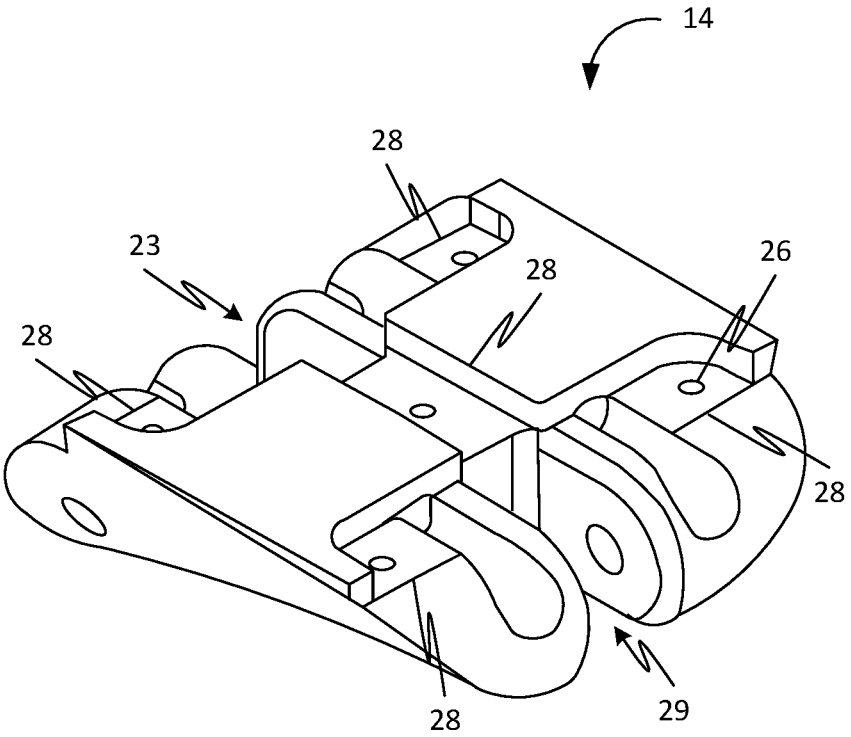
FIGS. 6-8 are various views of a middle hinge member forming part of the hinge assembly of FIGS. 1-2 according to aspects of the invention.
Figure 7:
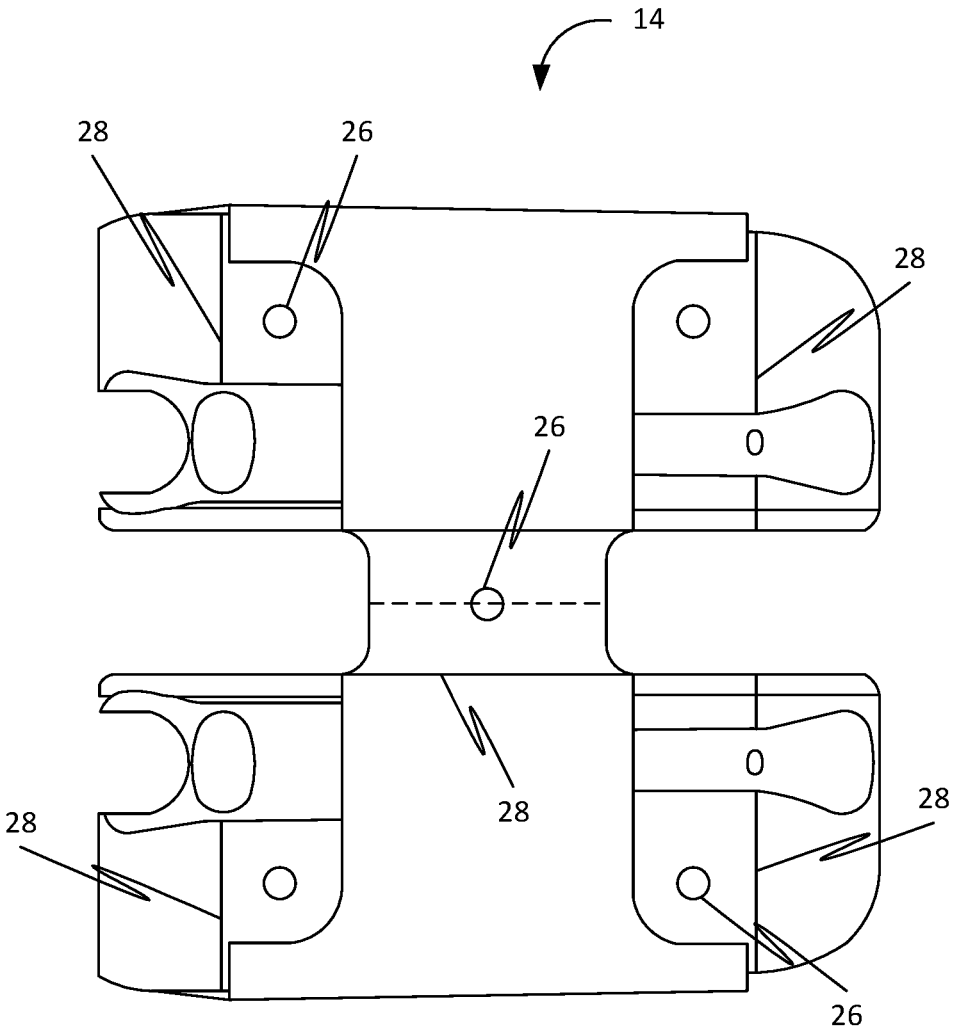
Figure 8:
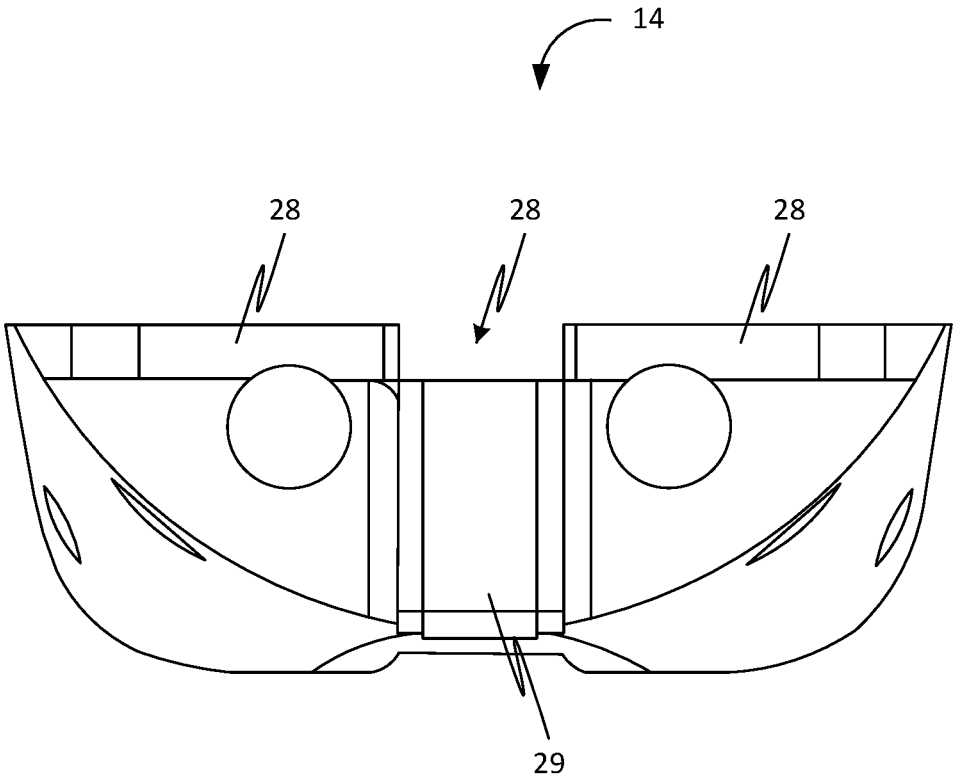
Figure 9:
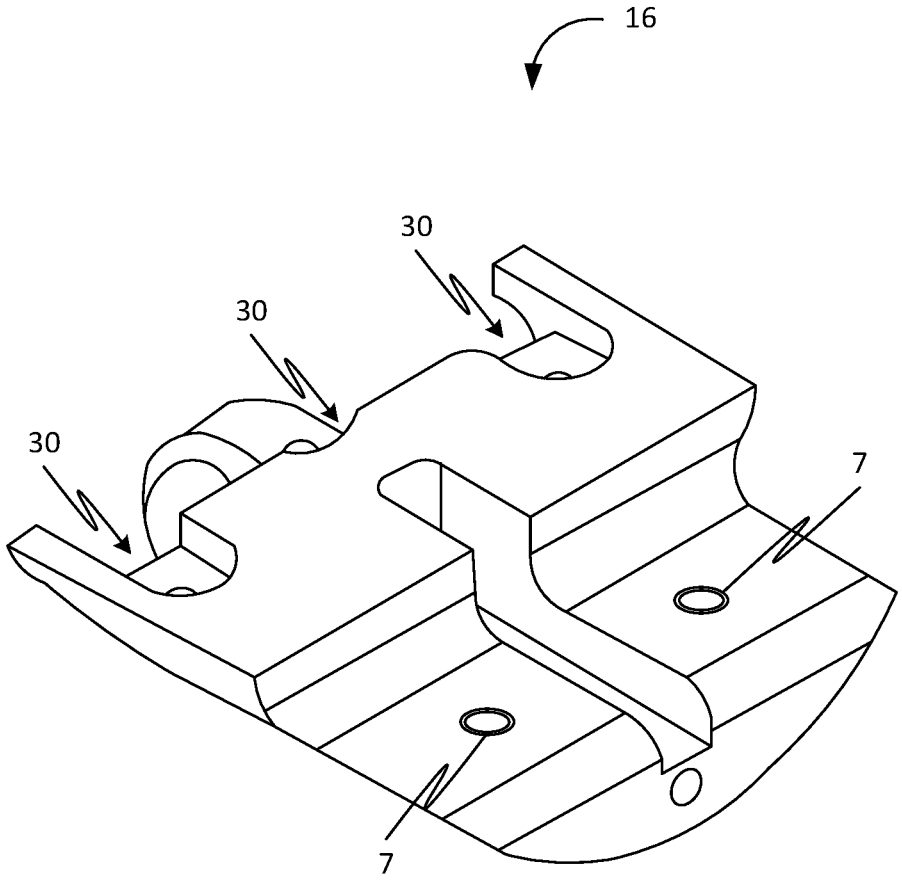
FIGS. 9-11 are various views of an upper hinge member forming part of the hinge assembly of FIGS. 1-2 according to aspects of the invention.
Figure 10:
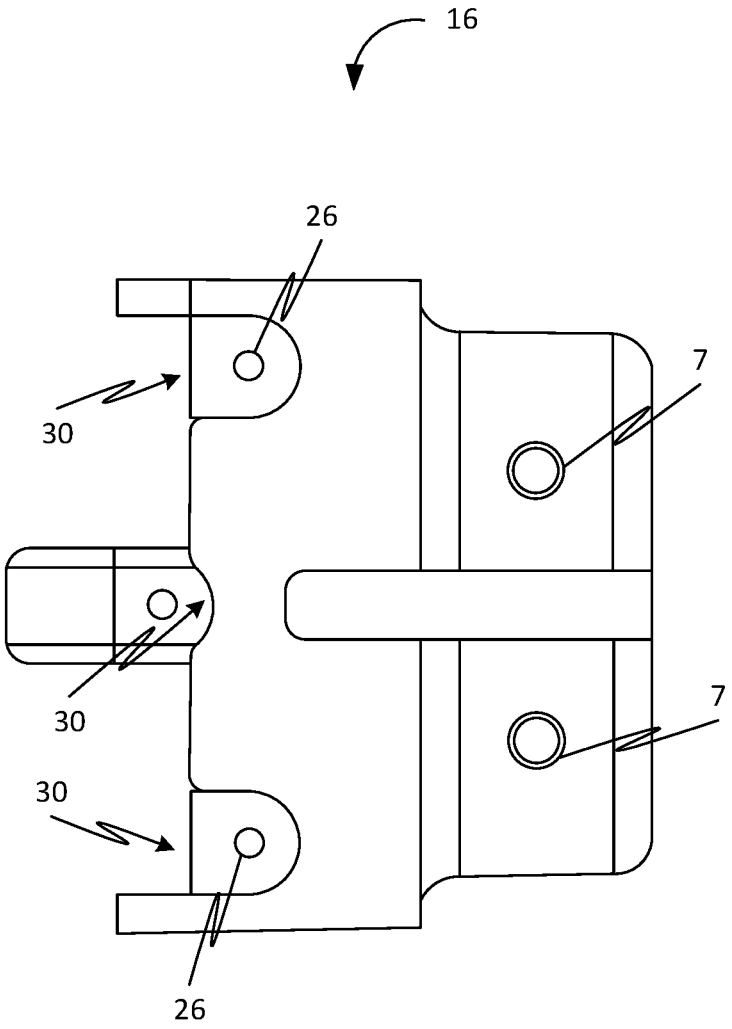
Figure 11:
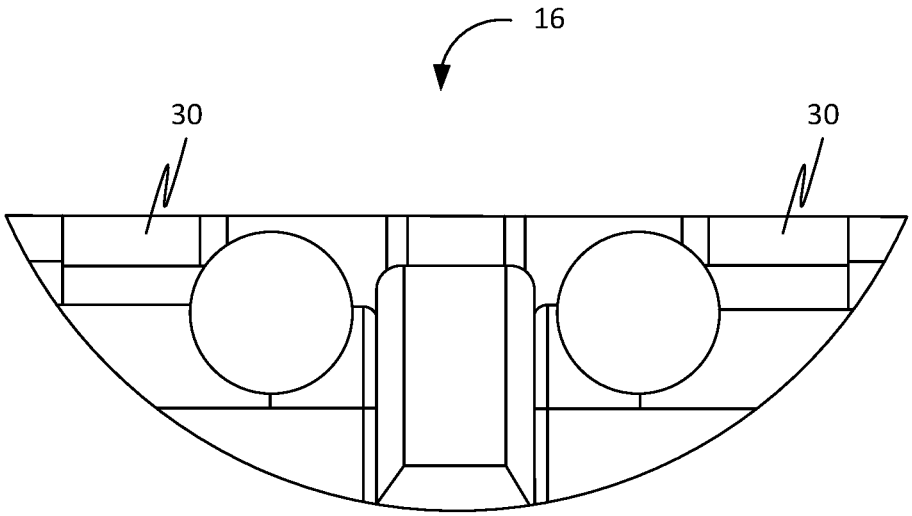
Figure 12:
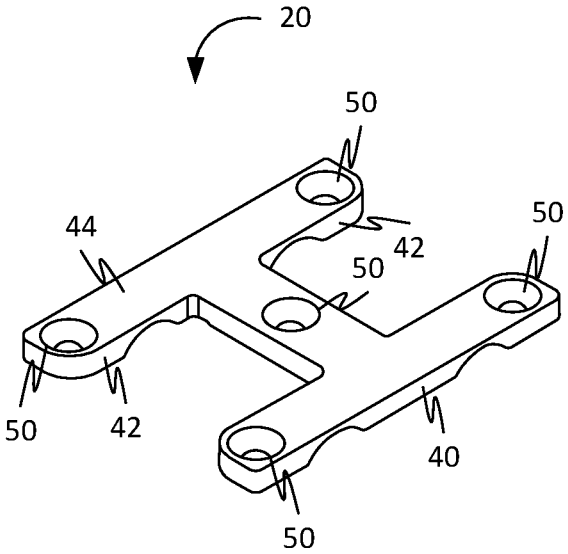
FIGS. 12-15 are various views of an H-shaped strike plate forming part of the hinge assembly of FIGS. 1-2 (for use in the middle hinge member of FIGS. 6-8) according to aspects of the invention.
Figure 13:
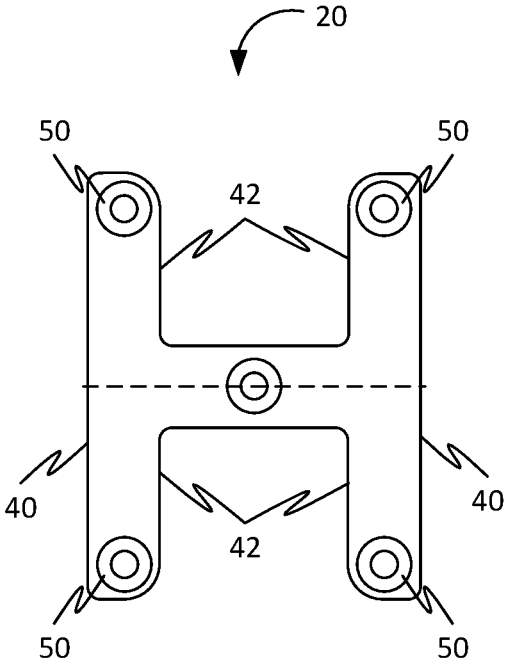
Figure 14:
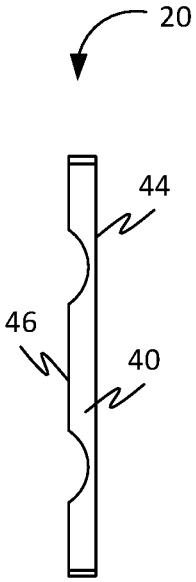
Figure 15:
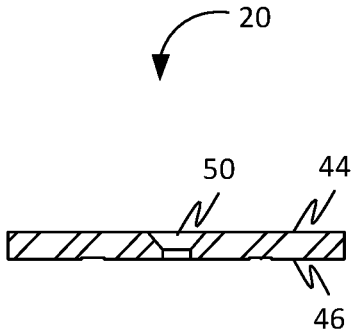
Figure 16:
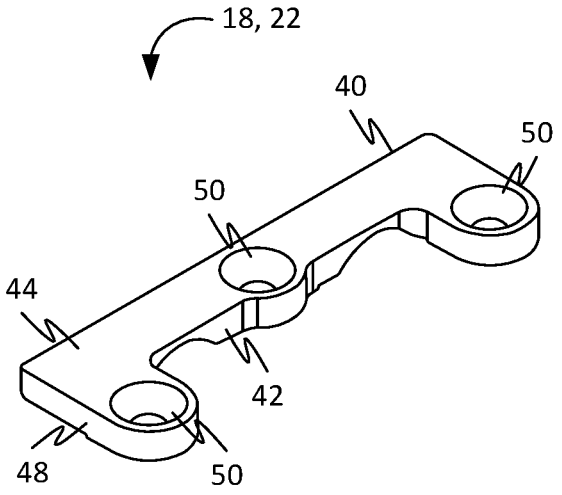
FIGS. 16-19 are various views of a U-shaped strike plate forming part of the hinge assembly of FIGS. 1-2 (for use in the hinge base of FIGS. 3-5 and the upper hinge of FIGS. 9-11) according to aspects of the present invention.
Figure 17:
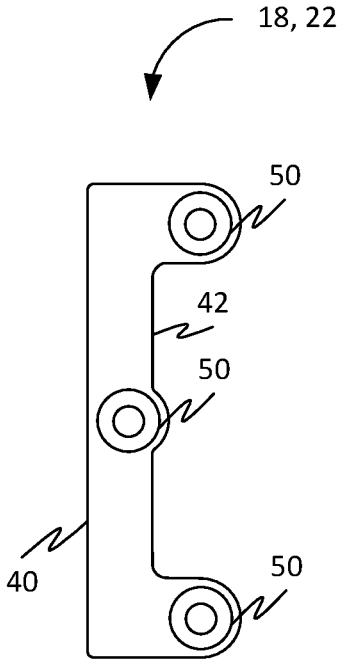
Figure 18:
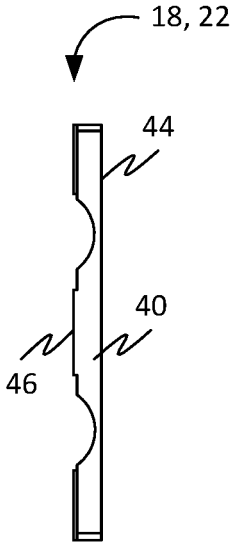
Figure 19:
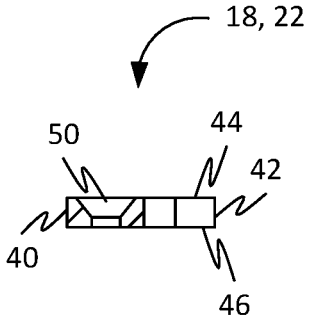
Figure 20:
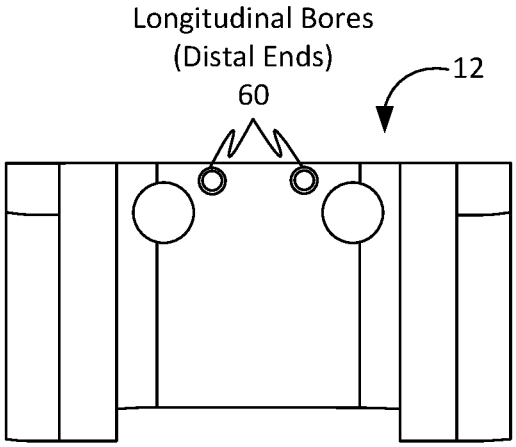
FIGS. 20-22 are various views of the base hinge section equipped to receive one or more features for selectively adjusting the position of the respective strike plates.
Figure 21:
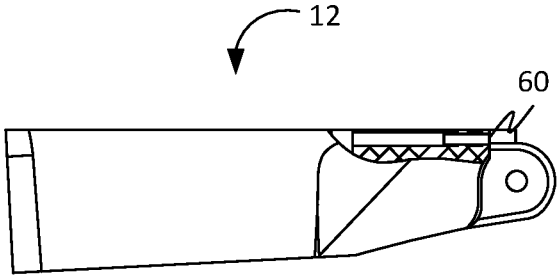
Figure 22:
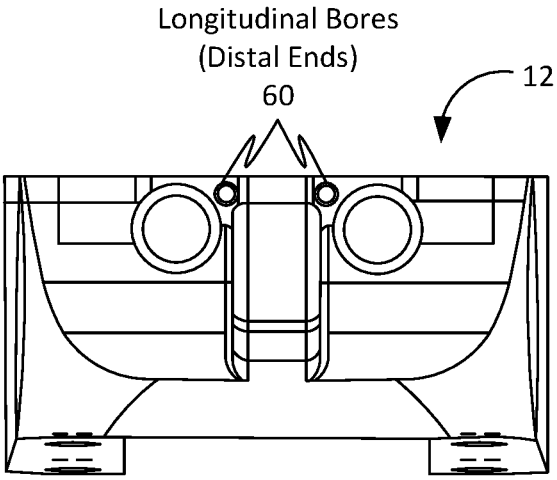
Figure 23:
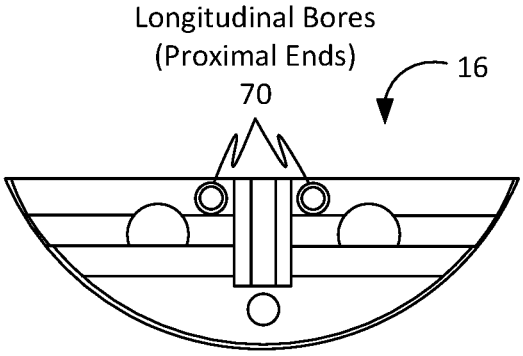
FIGS. 23-25 are various views of the base hinge section equipped to receive one or more features for selectively adjusting the position of the respective strike plates.
Figure 24:
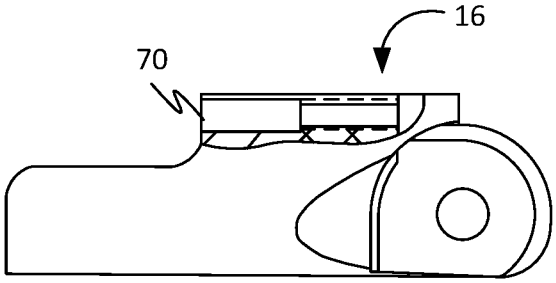
Figure 25:
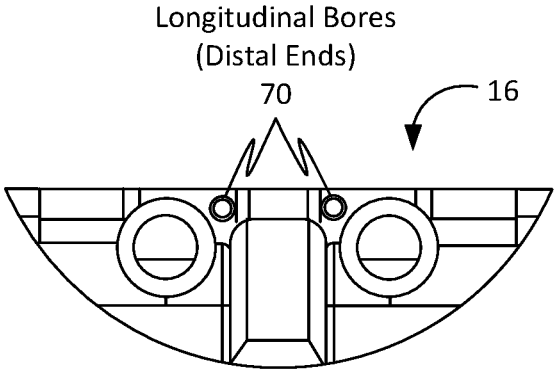

As shown in FIGS. 3-5, the base section 12 includes a recess 24 dimensioned to mount the strike plate 18 via machine screws 25 in threaded apertures 26. In one embodiment, the recess 24 has the same general perimeter shape as the outer perimeter shape of the strike plate 18 (generally U-shaped as shown in FIGS. 16-19). The recess 24 also includes multiple threaded holes 26 to receive the threaded screws 25 for the purpose of mounting the strike plate 18 to the base section 12 of the hinge assembly 10. As shown in FIGS. 6-8, the middle section 14 includes a recess 28 dimensioned to mount the strike plate 20 via machine screws 25 in threaded apertures 26. In one embodiment, the recess 28 has the same general perimeter shape as the outer perimeter shape of the strike plate 20 (generally H-shaped as shown in FIGS. 12-15). As shown in FIGS. 9-11, the upper section 16 includes a recess 30 dimensioned to mount the strike plate 22 via machine screws 25 in threaded apertures 26. In one embodiment, the recess 30 has the same general perimeter shape as the outer perimeter shape of the strike plate 22 (generally U-shaped as shown in FIGS. 16-19).

As shown in FIGS. 16-19, strike plates 18 and 22 have the same design, with each having a generally U-shape outer periphery dimensioned to be mounted within the recess 24 of the base section 12 and the recess 30 of the upper section 16, respectively. Each strike plate 18, 22 includes an abutment surface 40, a load transfer surface 42, an upper surface 44, a lower surface 46, retaining side surfaces 48, and multiple apertures 50 dimensioned to receive the machine screws 25 for mounting the strike plate 18 within the recess 24. The abutment surface 40 is preferably perpendicular to the upper surface 44 and lower surface 46 such that, when brought into position against a corresponding abutment surface of the strike plate 20 in the middle section 14, each will be positioned flush against one another (vs. point loading) for maximum engagement. The load transfer surface 42 is dimensioned to match a portion of the interior periphery of the recesses 24, 30 such that, when the base section 12, middle section 14 and upper section 16 are straightened relative to one another (FIG. 1), the loads exerted upon the strike plates 18, 20 are transferred or otherwise distributed to the base section 12 and the upper section 16, respectively. Preferably, there should be no or negligible gap between the load transfer surface 42 of the strike plate 18 and the inner periphery of the recesses 24, 30 of the base section 12 and upper section 16. The retaining side surfaces 48 are dimensioned to match a corresponding section within the recesses 24, 30, although there may be a slight gap therebetween because this surface does not act to transfer loads as with the load transfer surface 42.

As shown in FIGS. 12-15, the strike plate 20 has a general H-shape and is dimensioned to be mounted in the recess 28 of the middle section 14 of the hinge 10. In similar fashion as the strike plates 18, 22 described above, the strike plate 20 includes a pair of abutment surfaces 40 on either end, a pair of load transfer surfaces 42 opposite each abutment surface 40, an upper surface 44, a lower surface 46, retaining side surfaces 48, and multiple apertures 50 dimensioned to receive the machine screws 25 for mounting the strike plate 20 within the recess 28. Each abutment surface 40 is preferably perpendicular to the upper surface 44 and lower surface 46 such that, when brought into position against a corresponding abutment surface of the strike plates 18, 22 in the base section 12 and upper section 16, respectively, each will be positioned flush against one another (vs. point loading) for maximum engagement. Each load transfer surface 42 is dimensioned to match a portion of the interior periphery of the recess 28 such that, when the base section 12, middle section 14 and upper section 16 are straightened relative to one another (FIG. 1), the loads exerted upon the strike plate 20 are transferred or otherwise distributed to the middle section 14. Preferably, there should be no or negligible gap between the load transfer surface 42 of the strike plate 20 and the inner periphery of the recess 28 of the middle section 14. The retaining side surfaces 48 are dimensioned to match a corresponding section within the recess 28, although there may be a slight gap therebetween because this surface does not act to transfer loads as with the load transfer surface 42.

Although shown mounted via threaded screws 25, it will be appreciated that each strike plate 18, 20, 22 may be secured within the corresponding recess in any number of suitable fashions, including but not limited to adhesive (e.g. epoxy, super glue, etc. . . . ) and/or one or more machine screws dimensioned to extend through apertures formed in the strike plates into threaded holes formed within the corresponding hinge section.

When the hinge assembly 10 is straightened as shown in FIG. 1, each adjacent abutment surface 40 will be contacting one another (preferably in a parallel manner with maximum contact area between each abutment surface) to define the first abutment joint 11 (contact region) between the hinge base 12 and the middle hinge 14, and the second abutment joint 13 (contact region) between the middle hinge 14 and upper hinge 16. The first and second contact regions 11, 13 are disposed generally along the upper surface of the hinge assembly 10 such that only the strike plates 18, 20 and 20, 22 will be contacting on another along the upper region of the hinge assembly 10. In this manner, the underlying material used to construct the base section 12, middle section 14, and upper section 16 will be less likely to be deformed over time due to repetitive use. This is especially the case if the material used for the base section 12, middle section 14 and/or upper section 16 is softer or less durable than the material used for the strike plates 18, 20, 22. For example, if Aluminum is used for the hinge base 12, middle link 14 and/or upper link 16, then strike plates 18, 20, 22 made from hardened steel would bolster the overall durability of the hinge assembly 10 over time, given that the loads would be borne by the strike plates 18, 20, 22 and transferred into the respective hinge components, as opposed to having Aluminum bear those loads and deform over time.

As shown in FIGS. 20-25, the hinge assembly may be equipped with an optional adjustability feature that allows the position of one or more of the strike plates 18, 22 to be selectively adjusted to: a) ensure the spacing between the strike plates 18, 20, 22 is optimally zero, as in the strike plates 18, 20, 22 are in physical and substantially flush abutment when the hinge assembly 10 is fully deployed as shown in FIG. 1; and/or b) ensure the upper surfaces of the base section 12, middle section 14 and upper section 16) are substantially co-planar and flat relative to one another when the hinge assembly 10 is fully deployed as shown in FIG. 1. In the absence of this adjustability feature, the machining tolerances must be maintained at extremely tight levels. Reliance of such tight tolerances can give rise to instances where an unwanted gap may exist between the strike plates 18, 20, 22 during hinge assembly. Without the ability to adjust the strike plates 18, 20, 22 into abutment (preferably substantially flush abutment), two potential issues arise. First, the upper surfaces of the hinge base 12, middle section 14, and/or upper section 16 may be out of coplanar alignment after assembly of the hinge 10. Second, if a gap exists between the strike plates 18, 20, 22, then the hinge assembly 10 may hyper-extend (that is, yield upwards) if upward forces are applied to the bottom of the base section 12 and/or upper section 16 while maintaining the middle section 14 static.

By way of example only, hinge adjustability is accomplished by adding a pair of set screws in the base section 12 and upper section 16. More specifically, the base section 12 and upper section 16 are each equipped with longitudinal bores 60, 70, respectively, each having a proximal end and a distal end and extending generally parallel to the upper surface of the base section 12 and upper section 16. The distal ends of each longitudinal bore 60, 70 intersect the strike plate recesses 24, 30 in the base section 12 and upper section 16, respectively. The proximal ends of each longitudinal bore 60, 70, along with a majority of each longitudinal bore 60, 70, are smooth and non-threaded while the interior of each longitudinal bore 60, 70 is threaded near the distal ends. The threaded distal section of each longitudinal bore 60, 70 is dimensioned to receive a set screw capable of being selectively driven inward or outward with an elongated driver (e.g. hex driver) that is passed from the distal end of each longitudinal bore 60, 70 for engagement with the respective set screw. Because the distal end of each longitudinal bore 60, 70 intersects the strike plate recesses 24, 30 in the base section 12 and upper section 16, the set screws may be selectively brought into contact with the strike plates 18, 22 and the position of each strike plate 18, 22 selectively adjusted to ensure there is no gap between the U-shaped strike plates 18, 22 and the H-shaped strike plate 20. In addition to adjusting for zero gap between the strike plates 18, 20, 22, the set screws may also be used to ensure the upper surfaces of the base section 12, middle section 14 and/or the upper section are co-planar and flat as possible.

The strike plates 18, 22 can be moved under force from the set screws to the optimal location and locked in place for robust, consistent operation. This may be facilitated by providing elongated recesses in the strike plates 18, 22 for receiving the mounting screws 25 in lieu of apertures 50 described above. From a workflow standpoint, the middle strike plate 20 is first mounted within the recess 28 via threaded screws 25. The strike plates 18, 22 are next introduced into the recesses 24, 30 and the mounting screws 25 are maintained in a loose state. A user may then selectively adjust the location of each U-shaped strike plate 18, 22 to ensure they are in flush abutment (i.e. zero gap) and optionally with each surface in co-planar state with the abutment surfaces 40 of the strike plate 20. Once positioned in the preferred location, the user may tighten the mounting screws to maintain the strike plates 18, 22 in the desired location. Optionally, if any gap exists between the load transfer surface 42 of the strike plates 18, 22 and the interior of the recesses 24, 30 due to the positional adjustment of the strike plates 18, 22, a user may desire to introduce one or more shims or other structures in the resulting gap. This may help maintain the strike plates in position during use of the hinge assembly over time, to ward against any deformation or translation that may occur in the set screws over time.

The adjustability feature described above provides the ability to ensure zero-gaps between the strike plates 18, 20, 22 of the hinge assembly 10, as well as co-planar surfaces of the hinge base 12, middle link 14, and upper link 16, during the process of assembling and setting up the hinge assembly 10. While described above using set screws within the longitudinal bores 60, 70 to selectively adjust the position of the strike plates 18, 22, it is also within the scope of the present invention to accomplish the strike plate adjustability via an externally driven manner, for example, a magnetically driven servo motor disposed within the base section 12 and/or upper section 16 that can be selectively adjusted over time.

The hinge assembly 10 may be constructed from any number of suitable materials, including but not limited to metal (e.g. aluminum), carbon-fiber, plastic, etc. . . . manufactured via any suitable techniques, including but not limited to machining, molding, 3D printing, etc. . . . . The strike plates 18, 20, 22 are preferably made of a highly robust and durable material relative to the material of the hinge base, middle hinge, and upper hinge, such that the strike plates will not deform or otherwise get negatively impacted from repeated contact during the folding and unfolding over the lifetime of the foldable stringed instrument. By way of example only, the strike plates 18, 20, 22 may be constructed from tool-grade steel heat treated to achieve hardness RC, although it will be appreciated that any number of suitable materials and/or hardness and/or durometers may be employed without departing from the present invention.

Any of the features or attributes of the above the above described embodiments and variations can be used in combination with any of the other features and attributes of the above described embodiments and variations as desired. From the foregoing disclosure and detailed description of certain preferred embodiments, it is also apparent that various modifications, additions and other alternative embodiments are possible without departing from the true scope and spirit. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A hinge assembly with reinforced abutments, comprising:

an upper hinge member, a lower hinge member, and a middle hinge member hingedly coupled between said upper hinge member and said lower hinge member via a first connecting pin linking the upper hinge member to the middle hinge member and a second connecting pin linking the lower hinge member to the middle hinge member such that said hinge assembly is configured to be positioned into a straightened state and a folded state;

the upper hinge member having an upper surface, a first recess formed along a first end of said upper surface, and at least one connecting pin bore dimensioned to receive said first connecting pin;

the lower hinge member having an upper surface, a second recess formed along a first end of said upper surface, and at least one connecting pin bore dimensioned to receive said second connecting pin;

the middle hinge member having an upper surface, a third recess formed along a first end of said upper surface, a fourth recess formed along a second end of said upper surface, at least one connecting bore dimensioned to receive said first connecting pin, and at least one connecting bore dimensioned to receive said second connecting pin;

a first abutment joint formed between an abutment surface of a first strike plate mounted within said first recess of said upper hinge member and an abutment surface of a third strike plate mounted within said third recess of said middle hinge member when said upper hinge member and said middle hinge member are in said straightened state with said upper surface of said upper hinge member generally co-planar with said upper surface of said middle hinge member; and a second abutment joint formed between an abutment surface of a second strike plate mounted within said second recess of said lower hinge member and an abutment surface of a fourth strike plate mounted within said fourth recess of said middle hinge member when said lower hinge member and said middle hinge member are in said straightened state with said upper surface of said lower hinge member generally co-planar with said upper surface of said middle hinge member;

wherein said first abutment joint is configured to be selectively opened by rotating said upper hinge member relative to said middle hinge member and said second abutment joint is configured to be selectively opened by rotating said lower hinge member relative to said middle hinge member when said upper hinge member, said lower hinge member, and said middle hinge member are positioned into said folded state.

2. The hinge assembly of claim 1, wherein at least one of said first strike plate is adjustable relative to said upper hinge member and said second strike plate is adjustable relative to said lower hinge member.

3. The hinge assembly of claim 1, wherein said third strike plate and said fourth strike plate are integrally connected.

4. The hinge assembly of claim 1, wherein said first recess of said upper hinge member has a perimeter and shape that approximates at least a portion of said first strike plate.

5. The hinge assembly of claim 1, wherein said second recess of said lower hinge member has a perimeter and shape that approximates at least a portion of said second strike plate.

6. The hinge assembly of claim 1, wherein said third recess of said middle hinge member has a perimeter and shape that approximates at least a portion of said third strike plate.

7. The hinge assembly of claim 1, wherein said fourth recess of said middle hinge member has a perimeter and shape that approximates at least a portion of said fourth strike plate.

8. The hinge assembly of claim 1, wherein said first strike plate is coupled to said upper hinge member via at least one of an adhesive and a machine screw.

9. The hinge assembly of claim 1, wherein said second strike plate is coupled to said lower hinge member via at least one of an adhesive and a machine screw.

10. The hinge assembly of claim 1, wherein each of said third strike plate and said fourth strike plate is coupled to said middle hinge member via at least one of an adhesive and a machine screw.

11. A hinge assembly with reinforced abutments, comprising:

an upper hinge member, a middle hinge member, a lower hinge member, a first connecting pin for coupling said upper hinge member to said middle hinge member, and a second connecting pin for coupling said middle hinge member to said lower hinge member such that said hinge assembly is configured to be positioned into a straightened state and a folded state;

said upper hinge member having a generally flat upper surface and a first strike plate mounted within a recess formed along a first end of said upper surface, wherein said first strike plate has an abutment surface that is generally perpendicular to said upper surface and extends a majority of a width of said upper hinge member;

said lower hinge member having a generally flat upper surface and a second strike plate mounted within a recess formed along a first end of said upper surface, wherein said second strike plate has an abutment surface that is generally perpendicular to said upper surface and extends a majority of a width of said lower hinge member;

said middle hinge member having a generally flat upper surface, a third strike plate mounted within a recess formed along a first end of said upper surface, a fourth strike plate mounted within a recess formed along a second end of said upper surface, wherein each of said third strike plate and said fourth strike plate has an abutment surface that is generally perpendicular to said upper surface and extends a majority of a width of said middle hinge member;

wherein a first abutment joint is formed between said abutment surface of said first strike plate and said abutment surface of said third strike plate when said upper hinge member and said middle hinge member are in said straightened state with said upper surface of said upper hinge member generally co-planar with said upper surface of said middle hinge member;

wherein a second abutment joint is formed between said abutment surface of said second strike plate and said abutment surface of said fourth strike plate when said lower hinge member and said middle hinge member are in said straightened state with said upper surface of said lower hinge member generally co-planar with said upper surface of said middle hinge member; and wherein said first abutment joint is configured to be selectively opened by rotating said upper hinge member relative to said middle hinge member and said second abutment joint is configured to be selectively opened by rotating said lower hinge member relative to said middle hinge member when said upper hinge member, said middle hinge member, and said lower hinge member are positioned into said folded state.

12. The hinge assembly of claim 11, wherein at least one of said first strike plate is adjustable relative to said upper hinge member and said second strike plate is adjustable relative to said lower hinge member.

13. The hinge assembly of claim 11, wherein said third strike plate and said fourth strike plate are integrally connected.

14. The hinge assembly of claim 11, wherein said first recess of said first hinge member has a perimeter and shape that approximates at least a portion of said first strike plate.

15. The hinge assembly of claim 11, wherein said second recess of said second hinge member has a perimeter and shape that approximates at least a portion of said second strike plate.

16. The hinge assembly of claim 11, wherein said third recess of said third hinge member has a perimeter and shape that approximates at least a portion of said third strike plate.

17. The hinge assembly of claim 11, wherein said fourth recess of said third hinge member has a perimeter and shape that approximates at least a portion of said fourth strike plate.

18. The hinge assembly of claim 11, wherein said first strike plate is coupled to said first hinge member via at least one of an adhesive and a machine screw.

19. The hinge assembly of claim 11, wherein said second strike plate is coupled to said second hinge member via at least one of an adhesive and a machine screw.

20. The hinge assembly of claim 11, wherein each of said third strike plate and said fourth strike plate is coupled to said third hinge member via at least one of an adhesive and a machine screw.

* * * * *